US007410083B2

(12) United States Patent
Reid

(10) Patent No.: US 7,410,083 B2
(45) Date of Patent: Aug. 12, 2008

(54) TRAFFIC TICKET BOOK HOLDER

(76) Inventor: Glen Reid, 3 Pell St., Ontario (CA) M1N 1M9

( * ) Notice: Subject to any disclaimer, the term of this patent is extended or adjusted under 35 U.S.C. 154(b) by 0 days.

(21) Appl. No.: 11/121,098

(22) Filed: May 4, 2005

(65) Prior Publication Data

US 2005/0199715 A1 Sep. 15, 2005

Related U.S. Application Data

(63) Continuation-in-part of application No. 10/625,690, filed on Jul. 24, 2003.

(51) Int. Cl.
*A45F 3/14* (2006.01)
*A45C 13/30* (2006.01)

(52) U.S. Cl. ..... 224/661; 224/222; 224/677; 224/914

(58) Field of Classification Search ..... 190/902, 190/903, 112, 113; 206/232, 449; 224/661, 224/257, 576, 930, 221, 222, 219, 605, 624, 224/627; 220/522; 150/118, 119
See application file for complete search history.

(56) References Cited

U.S. PATENT DOCUMENTS

| | | | | | |
|---|---|---|---|---|---|
| 956,534 | A | | 5/1910 | Lahey | |
| 1,368,579 | A | * | 2/1921 | Schochet | 150/118 |
| 2,413,465 | A | * | 12/1946 | Ohlsen | 150/117 |
| 3,199,754 | A | * | 8/1965 | Sorensen | 224/222 |
| 3,454,068 | A | * | 7/1969 | Copen et al. | 190/109 |
| 4,236,559 | A | * | 12/1980 | Archbold | 224/610 |
| 4,415,106 | A | | 11/1983 | Connell et al. | |
| D275,819 | S | * | 10/1984 | Leiserson | D3/267 |
| 4,500,019 | A | * | 2/1985 | Curley, Jr. | 224/222 |
| 4,848,624 | A | * | 7/1989 | Clem | 224/222 |
| 5,009,347 | A | | 4/1991 | Phelps | |
| 5,160,001 | A | * | 11/1992 | Marceau | 190/102 |
| 5,170,917 | A | | 12/1992 | Tourigny | |
| 5,215,379 | A | * | 6/1993 | Pickard et al. | 383/37 |
| 5,265,719 | A | * | 11/1993 | Wand | 206/223 |
| 5,267,679 | A | * | 12/1993 | Kamaya et al. | 224/583 |
| 5,395,023 | A | * | 3/1995 | Naymark et al. | 224/682 |
| D362,540 | S | * | 9/1995 | McNamara et al. | D3/215 |
| 5,477,633 | A | | 12/1995 | Leinberger | |
| 5,477,998 | A | * | 12/1995 | Reckler | 224/586 |
| 5,494,157 | A | * | 2/1996 | Golenz et al. | 206/320 |
| 5,607,090 | A | * | 3/1997 | Brown | 224/217 |
| 5,779,122 | A | * | 7/1998 | Martinelli | 224/683 |
| 5,871,534 | A | * | 2/1999 | Messick et al. | 607/138 |

(Continued)

*Primary Examiner*—Nathan J. Newhouse
*Assistant Examiner*—Justin M. Larson
(74) *Attorney, Agent, or Firm*—Richard C. Litman

(57) ABSTRACT

The traffic ticket book holder has a main body connected to a protective flap by a top panel and connected to a front cover by a bottom panel. A pair of zipper tracks connects the right and left sides of the main body, front cover and bottom panel together. Main body, front cover, top panel, bottom panel and the zipper tracks define a generally rectangular shaped ticket compartment that carries a number of traffic ticket books and tickets. An elongated belt strap is releasably attached to the traffic ticket book holder for suspending the traffic book holder from the belt of the user. A flexible thigh strap is attached to the main body of the traffic ticket book holder to the upper thigh area of the user and a thigh adjustment piece to provide adjustment of the thigh strap for varying thigh sizes.

4 Claims, 13 Drawing Sheets

U.S. PATENT DOCUMENTS

| | | | | |
|---|---|---|---|---|
| 5,938,096 | A * | 8/1999 | Sauer et al. | 224/625 |
| 5,954,170 | A * | 9/1999 | Chisholm | 190/109 |
| 6,230,887 | B1 * | 5/2001 | Snider | 206/349 |
| 6,244,485 | B1 * | 6/2001 | Holland et al. | 224/584 |
| 6,398,021 | B1 * | 6/2002 | Smith | 206/232 |
| D465,326 | S * | 11/2002 | Hassett | D3/263 |
| 6,629,628 | B1 * | 10/2003 | Canepari et al. | 224/222 |
| D483,179 | S * | 12/2003 | Fair | D3/267 |
| 6,685,066 | B2 * | 2/2004 | Cragg | 224/192 |
| 2002/0084299 | A1 * | 7/2002 | Sorensen et al. | 224/661 |
| 2004/0040876 | A1 * | 3/2004 | Scribner | 206/425 |

* cited by examiner

TRAFFIC TICKET BOOK HOLDER

CROSS-REFERENCE TO RELATED APPLICATION

This application is a Continuation-In-Part of U.S. patent application Ser. No. 10/625,690, filed Jul. 24, 2003.

BACKGROUND OF THE INVENTION

1. Field of the Invention

The present invention relates to a traffic ticket book holder for carrying items on the thigh of a user. More specifically, it relates to a device to be suspended from a belt worn by a law enforcement officer, and secured to the thigh for carrying traffic tickets and ticket books.

2. Description of the Related Art

Many professionals and athletes require people to write tickets or carry important documentation or equipment as part of their work or performance. Many of these professionals must also be physically ready to quickly perform a task at a moment's notice. Devices that attach important documentation and equipment to a variety of professionals are also well-known in the related art.

U.S. Pat. No. 956,534 issued to Lahey, is a device worn on the wrist or arm of a user and is positioned to retain a memo pad. The device holds the memo pad and is designed particularly for use by waiters, the memo pad being easily secured to a waiter's forearm near the wrist, so as to leave the waiter's hands free, while at the same time holding the memo pad always in a convenient position for writing orders.

U.S. Pat. No. 4,415,106 issued to Connell et al., relates to a body supported printed surface in general, and more specifically, to a thin, flexible ski area map holder, which is easily attached to a skier's limb and provides a safe convenient view of an appropriate map.

U.S. Pat. No. 4,500,019 issued to Curley, Jr., describes a carrier for portable audio devices that is retained around a user's arm. This device has an armband with two inflatable chambers that fits around the contour of a user's arm. A receptacle is also attached to the armband for holding a portable audio device.

U.S. Pat. No. 5,009,347 issued to Phelps, is a wrist holster for carrying a gas canister. The holster is retained by a Velcro strip looped through a buckle and folded back on to itself. The invention, however, does not offer a method of preventing the holster from sliding along the forearm of a user.

U.S. Pat. No. 5,170,917 issued to Tourigny, relates to an article to be worn on the arm of a user for displaying a map or other document. The display article is formed from a pair of flexible panels joined along three edges and is selectively sealable and unsealable by the user along a fourth edge. The panels define a pocket for receiving the map or other document to be displayed. One of the panels provides a transparent window through which the map or document may be viewed.

U.S. Pat. No. 5,477,633 issued to Leinberger, outlines the use of a document holder during outdoor activities which do not normally leave the hands free to hold a document. The document holder has a plurality of flexible members joined together to form a pouch with a clear or otherwise see-through sheet, such as a mesh material, thereby allowing the document to be viewed.

Although the outlined patents describe various carrier apparatuses attachable to a user's body, none disclose any inventions that pertain to law enforcement officers. In the law enforcement profession, there is a need for an apparatus to carry such things as booklets of traffic tickets that are easily accessible, but are out of the way when sudden access to items such as weapons, batons, and handcuffs are necessary. Such an apparatus would be very valuable to law enforcement officers and would be in great demand in the marketplace.

None of the above inventions and patents, taken either singly or in combination, is seen to describe the instant invention as claimed. Thus, a traffic ticket book holder solving the aforementioned problems is desired.

SUMMARY OF THE INVENTION

A traffic ticket book holder is provided that has a generally rectangular shape that is suspended from a belt and secured to the thigh of a user. The holder has a main body with an upper edge, a front cover with a top and a bottom portion, an outer pocket on the bottom portion of the front cover to hold miscellaneous items, and a protective flap attached to the upper edge of the main body. The main body is connected to the protective flap by a top panel and connected to the front cover by a bottom panel. A first zipper track connects the right side edges of the main body and front cover together with a first end of the bottom panel and a second zipper track connects the left side edges of the main body and front cover together with a second end of the bottom panel. Main body, front cover, top panel, bottom panel and the first and second zipper tracks define a ticket compartment that carries a number of traffic ticket books and tickets. An elongated belt strap is releasably attached to the traffic ticket book holder for suspending the traffic book holder from the belt of the user. A flexible thigh strap is attached to the main body of the traffic ticket book holder to the upper thigh area of the user and a thigh adjustment piece to provide adjustment of the thigh strap for varying thigh sizes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
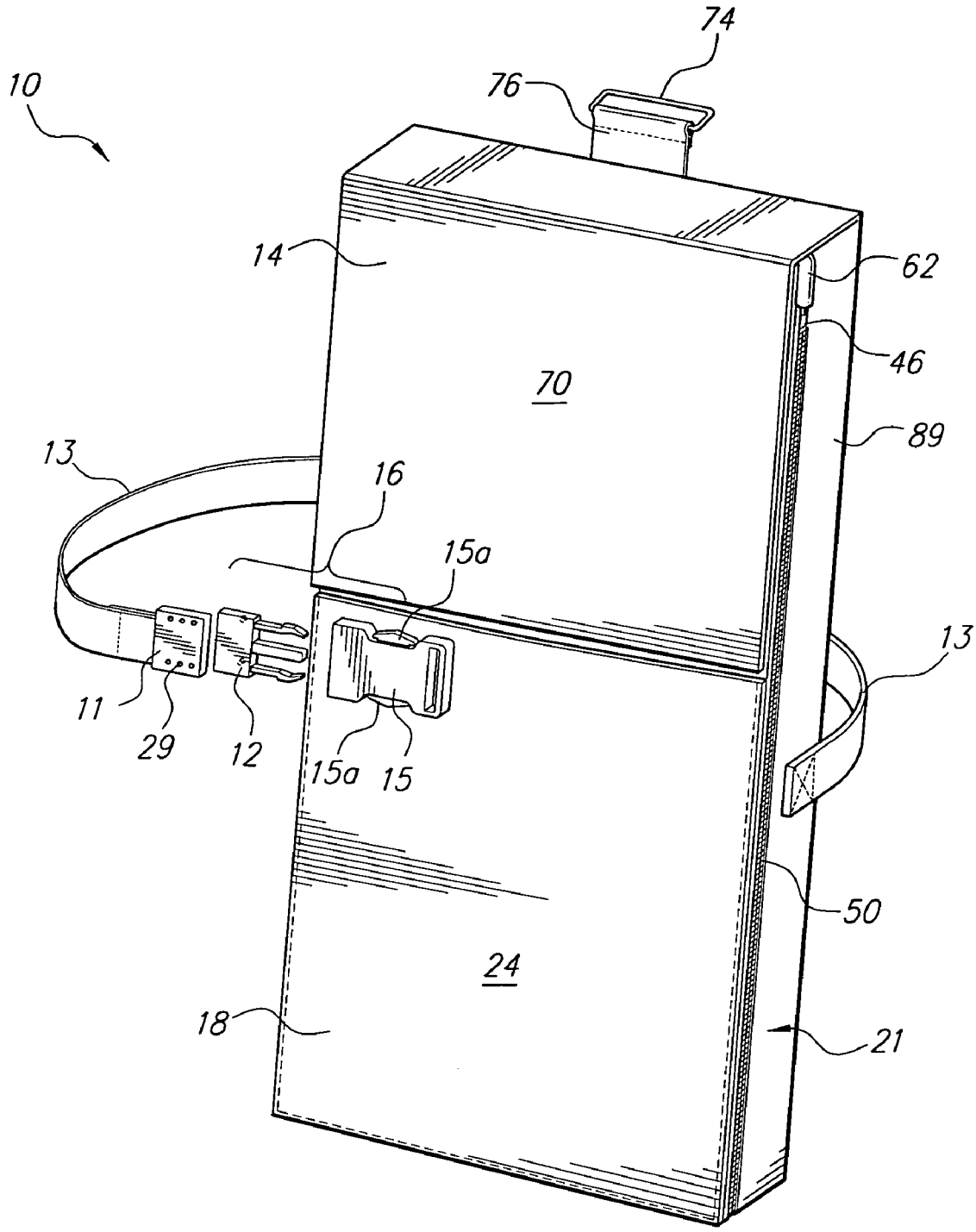
FIG. 1 is a front perspective view of a traffic ticket book holder according to the present invention.

The present invention is directed to a traffic ticket book holder 10 for law enforcement personnel that can be attached to the upper arm of an officer. FIG. 1 discloses a lightweight traffic ticket book holder 10 that is easily accessible yet out of the way when attached to a parking enforcement officer. The currently used traffic ticket book holders are not user friendly as they tend to be bulky, heavy and made of metal. With the size and weight of the current traffic ticket book holders, law enforcement officers are unable to carry them on their person.

A law enforcement officer carries standard issued equipment mainly on their belt. This equipment usually comprises a flashlight, a baton, a radio and handcuffs. With the belt cluttered with the standard equipment, there is no room to attach a traffic ticket book holder.

As is also depicted in FIG. 1, the traffic ticket book holder 10 has a generally rectangular shape. The main body 21 defines an inner compartment 70 that carries a number of traffic ticket books and tickets (not shown) and a front cover 18 that releasably seals the inner compartment 70. In this view, a shoulder strap 76 is shown attached to the traffic ticket book holder 10. A protective flap 14 is attached along an upper edge of the main body 21 to protect against various weather conditions and overlaps the top of the front cover 18. The front cover 18 has a fixed portion of a clip 15 affixed to it and an outer pocket 24 for miscellaneous items.

A flexible arm strap 13 is provided to secure the traffic ticket book holder 10 to the upper arm of a police officer. One end of the flexible arm strap 13 is attached to the right lateral side 89 of the traffic ticket book holder 10. The flexible arm strap 13 is attached to the upper arm of the parking enforcement officer and prevents any unwanted movement of the traffic ticket book holder 10. The flexible arm strap 13 may be manufactured of stretchable material to provide a snug fit around the upper arm of the police officer or user. One opposing end of the flexible arm strap 13 is attached to an arm adjustment piece 11. The flexible arm strap 13 further prevents the traffic ticket book holder 10 from dislodging when brushed up against something.

The arm adjustment piece 11 has a surface with a plurality of spaced apart snap buttons 29 to engage with recessed buttons (not shown) on a releasable portion 12 of the snap clip 16. The arm adjustment piece 11 is readily accessible to the officer to reattach any of the rows of buttons 29 with recessed buttons of the releasable portion 12 of the snap clip 16. Thus the arm adjustment piece 11 provides for varying arm sizes. The officer or user then can easily adjust the flexible arm strap 13 for comfort without cutting off blood circulation and providing enough tension to secure the traffic ticket book holder 10 to the arm of a user. The arm adjustment piece 11 can be designed as various different mechanisms so long as an adjustment of the flexible arm strap 13 is allowed to conform to the size of the user's arm and retain the traffic ticket book holder 10 in an attached position.

The releasable portion of the clip 12, when engaged with the fixed portion 15, together make up the snap clip 16. The fixed portion 15 is attached to the front cover 18 and the snap clip 16 can be detached when the sides 15*a* of the fixed portion 15 are depressed. The snap clip 16 is a pressure sensitive latch that is both easily locked and unlocked to allow for an easy release.

The snap clip 16 can also be provided with a safety release feature that allows the officer or user to quickly remove the traffic ticket book holder 10 from the arm of an officer or user, without depressing the snap clip 16 when necessary. The snap clip 16 can be designed to remain locked until a predetermined load is applied. In an emergency, the officer simply yanks or applies the predetermined load on the traffic ticket book holder 10 and the snap clip 16 disengages, thus allowing the traffic ticket book holder 10 to be removed quickly.

Typically to write out a citation, an officer must specifically recite the exact infraction of the law. These infractions or violations are contained in an offense specific book (not shown). This offense specific book can easily be carried in the front pocket 24 of the traffic ticket book holder 10. A portion of the front pocket 24 may be made of elastic material to allow for easier access. FIG. 1 discloses a front pocket 24 on the exterior of the front cover 18. Additional compartments may also be provided on the front cover 18 and on the main body 21.

Figure 2:
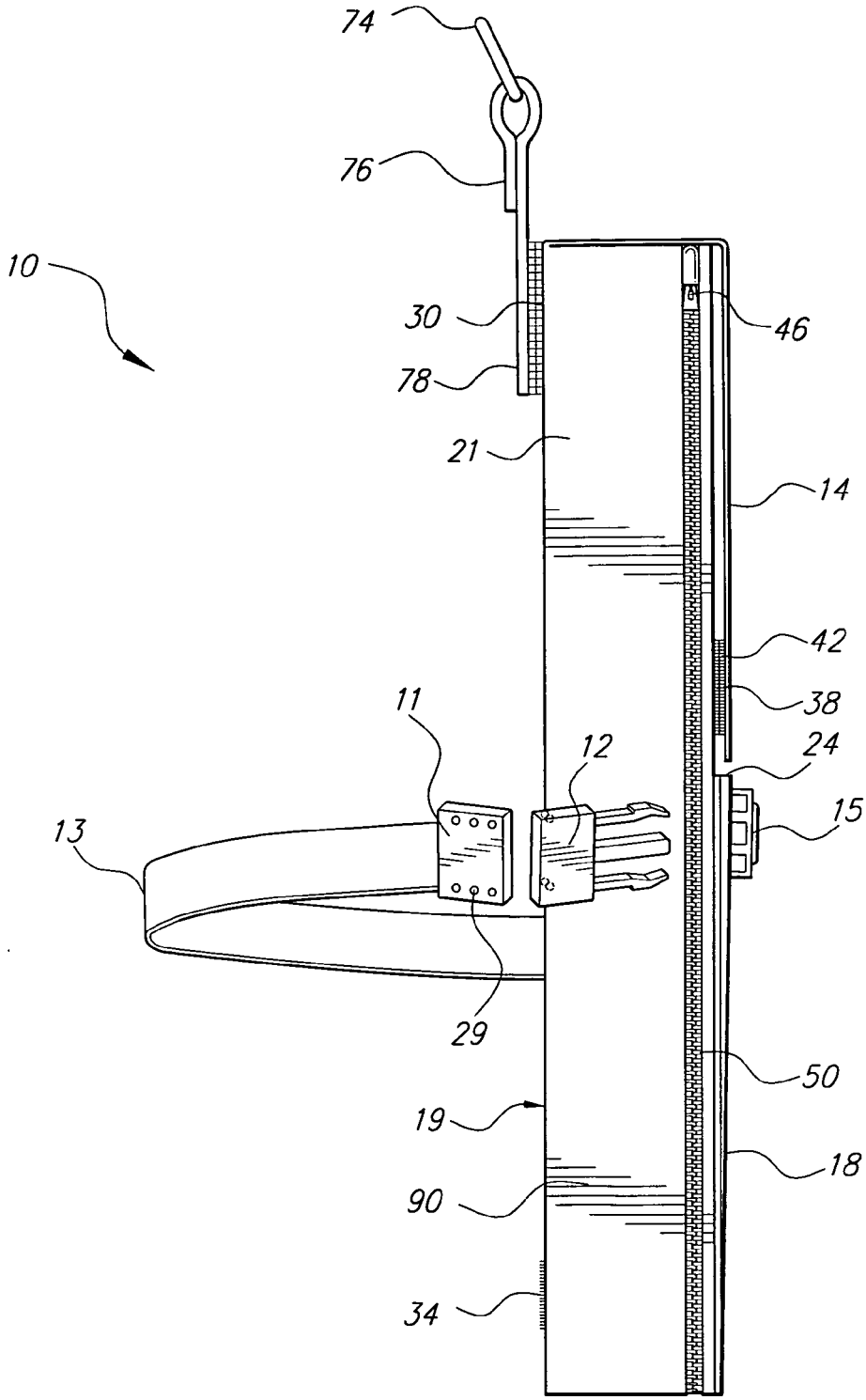
FIG. 2 is a side perspective view of a traffic ticket book holder.

FIG. 2 shows an upper rear fastener 30 located on the rear surface 19 of the main body 21 of the traffic ticket book holder 10. The upper rear fastener 30 mates with the opposing hook and loop fastener 78 to further secure the traffic ticket book holder 10 to the uniform of the officer. FIG. 2 shows the upper rear fastener 30 mated with the shoulder strap 76.

Figure 3:
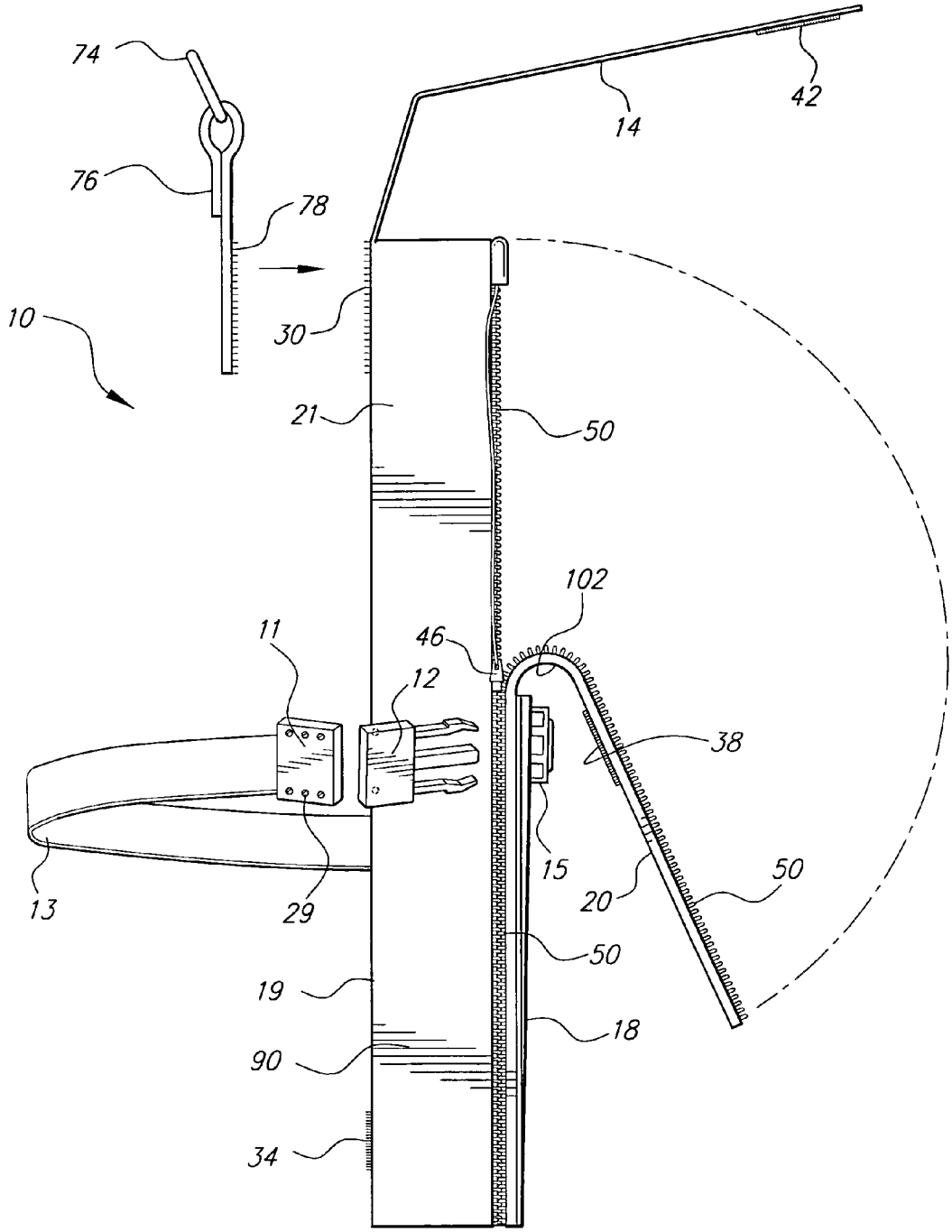
FIG. 3 is a side perspective view of a partially open traffic ticket book holder.

The officer releases a protective flap 14 from the front cover 18 via a flap fastener 38 and an upper front cover fastener 42. As mentioned previously, the protective flap 14 acts as a covering that protects the inner contents of the traffic ticket book holder 10 from inclement weather such as rain and snow. Zipper heads 46 are unzipped and lateral sides 90 of the main body 21 detach from the front cover 18 as shown in FIG. 3.

Figure 4:
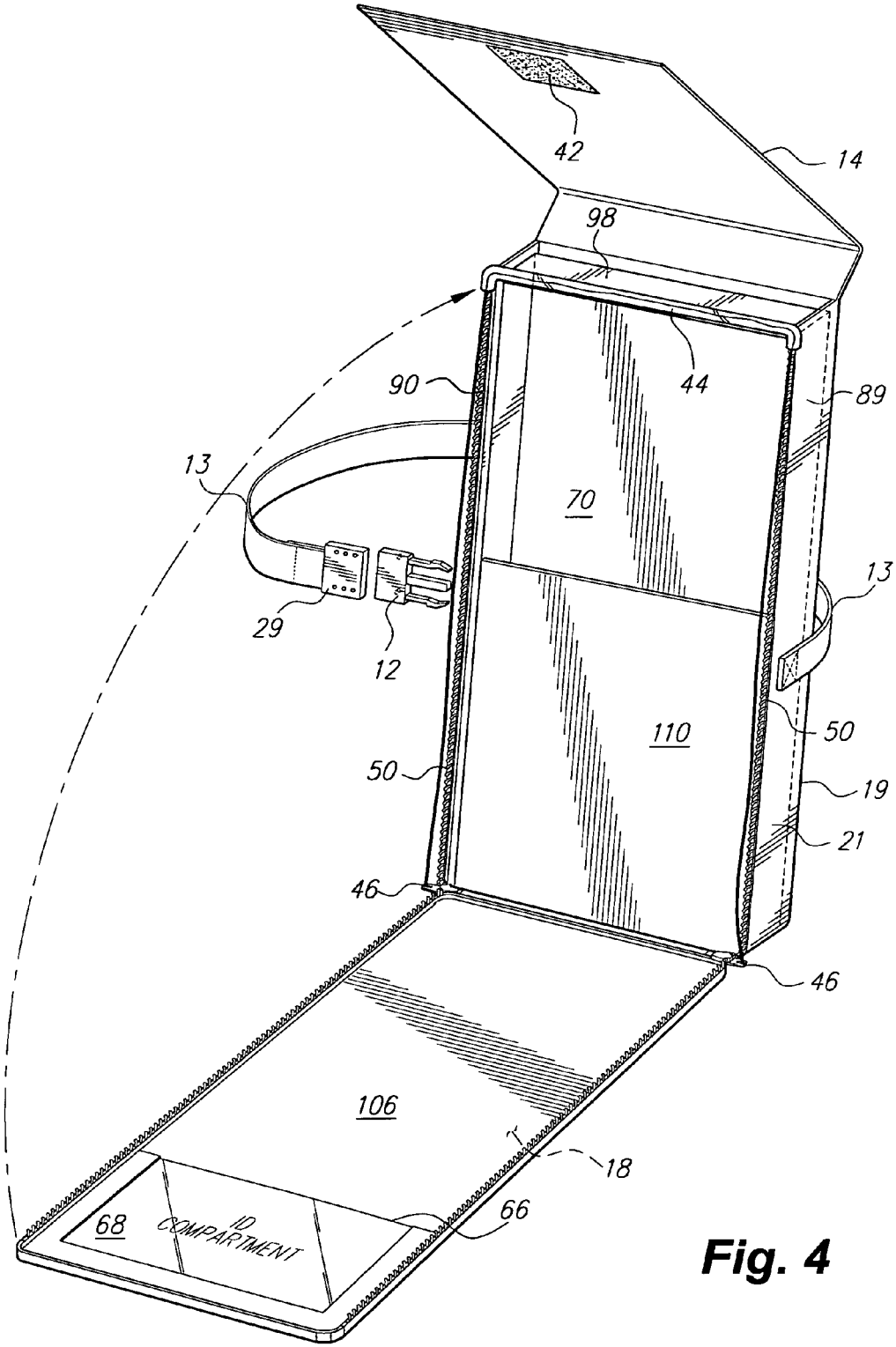
FIG. 4 is a front perspective view of a traffic ticket book holder that is in a fully open position.

The front cover 18 has an upper foldable portion 20 that folds at crease 102 for access to the identification pocket 66 and to the citations in the ticket compartment 70. As shown in FIG. 4, the identification pocket 66 has a window 68, so that when the offender's identification is placed in the pocket 66, the officer may easily copy the information from the identification to the ticket. For further access to the ticket compartment 70, the front cover 18 can be fully opened as depicted in FIG. 4.

The main body 21 is designed to structurally define the ticket compartment 70 to accommodate multiple ticket booklets and retain the shape of the ticket compartment 70. Here a sleeve 110 is provided to maintain the integrity of the ticket compartment 70 and to retain any multiple ticket booklets. The ticket compartment 70 may also have multiple sub compartments or pockets (not shown) to further organize the various types of tickets and multiple ticket booklets, as well as other miscellaneous items.

The front cover 18 further defines the ticket compartment 70. The front cover 18 opens and closes the ticket compartment 70 with zipper heads 46. Two separate zipper heads 46 are used along two separate zipper tracks 50 that cover the right lateral side 89 and the left lateral side 90. The main body 21 is provided with a handle 44, as depicted in FIG. 4. The handle 44 is looped through the zipper ends. The handle 44 allows the drawstring to be looped through the zipper. By pulling on the handle 44 portion of the traffic ticket book holder 10, the traffic ticket book holder 10 can be closed. The handle 44 is concealed along the area between the upper side 98 and the protective flap 14 when the traffic ticket book holder 10 is in a closed position. The upper side 98 may also be spaced slightly below the upper edges of the right lateral side 89 and the left lateral side 90 and the rear surface 19. This provides an area to accommodate the handle 44.

Figure 5:
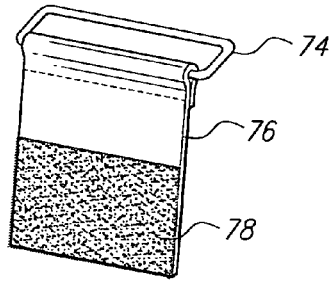
FIG. 5 is a front perspective view of an isolated shoulder strap used with a traffic ticket book holder.

FIG. 5 depicts a shoulder strap 76, which has a hook and loop type fastener 78 on an exterior surface that faces the rear surface 19 and releasably attaches with the upper fastener 30 located on the upper portion of the rear surface 19. The shoulder strap 76 also has a shoulder ring 74 to engage with the shoulder flap of the uniform. The shoulder flap of the uniform is looped through ring 74 and is buttoned to the uniform in the usual manner. By clasping the shoulder strap 76 to the shoulder flap of the uniform in this manner, the traffic ticket book holder 10 is prevented from sliding along the arm of the officer. The shoulder strap 76 and the opposing hook and loop fasteners 78 and 30 can be of any size depending on a predetermined load to remove the traffic ticket book holder 10 from the opposing hook and loop fasteners 78 and 30. The shoulder strap 76 may optionally be left on the uniform when the traffic ticket book holder 10 is not in use or when the uniform is being laundered. The shoulder ring 74 retains the shoulder strap 76 on the shoulder flap to prevent any sliding along the shoulder flap.

Figure 6:
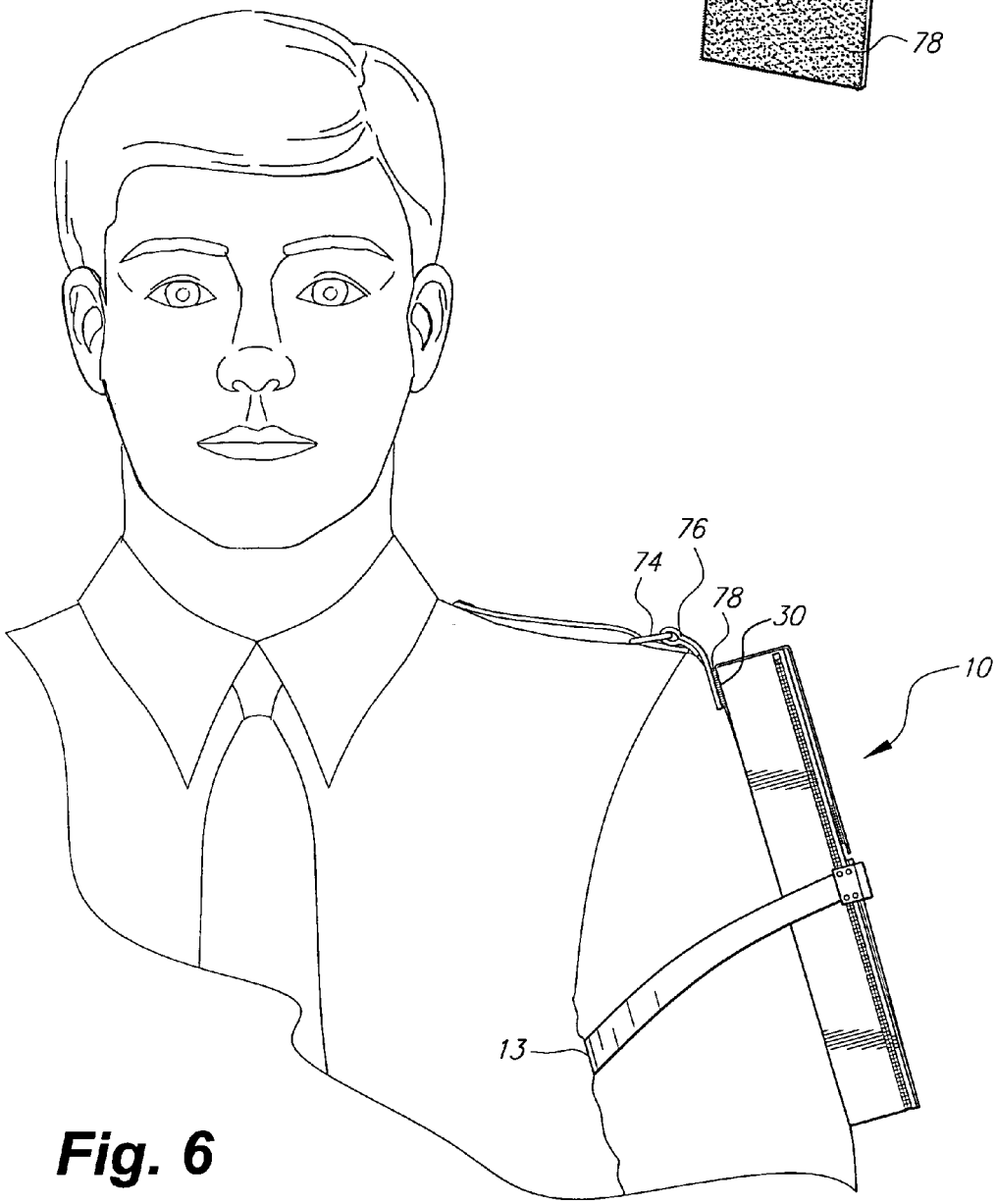
FIG. 6 is an environmental perspective side view of a traffic ticket book holder being worn by a user.

FIG. 6 also discloses the shoulder strap 76 and an armband 82 on the arm of the officer, with the traffic ticket book holder 10 attached in a closed position. The flexible armband 82 is fitted around the arm of the officer and is independent of the traffic ticket book holder 10.

Nearly all law enforcement paramedic and military uniforms, have shoulder flaps located on the opposing shoulders of their uniform. The officer=s police number can be placed here or it can be used to display any recognition or awards. One feature of the traffic ticket book holder 10 is that it attaches to the shoulder flap while still allowing the shoulder flap to be used in the usual manner. By utilizing the shoulder flap, the traffic ticket book holder 10 is secured to an officer's arm, thus freeing up the officer's hands and preventing the traffic ticket book holder 10 from sliding down the arm of the officer.

When the officer desires access to the contents of the traffic ticket book holder 10, he or she simply unlatches the snap clip 16 and pulls the traffic ticket book holder 10 away from his or her arm. The upper rear fastener 30 and the lower rear fastener 34 then detach from the opposing hook and loop fastener 78.

As can be seen in FIG. 6, the traffic ticket book holder 10 is fastened to the upper arm of an officer or user. To reattach the traffic ticket book holder 10, the officer simply attaches the opposing hook and loop fasteners 78 and the arm fastener 86 with the upper rear fastener 30. Flexible arm straps 13 are then wrapped around the arm of the user, and the releasable snap portion 12 is once again engaged with the fixed portion of the clip 15. In this manner, a police officer is able to carry citations with easy access, while also freeing the officer=s hands for quick action.

It is further appreciated that in cold weather, the traffic ticket book holder 10 can be secured to the exterior of a sweater or coat. The arm adjustment piece 11 can be adjusted to accommodate a sweater or jacket. Also law enforcement sweaters and coats typically have a shoulder flap, so the shoulder strap 76 can still be utilized in securing the traffic ticket book holder 10 to an officer's uniform.

Various materials may be used in the manufacture of the traffic ticket book holder 10. Any material that is resistant to wear and that can hold up in various weather conditions is preferable. Nylon may be one of many materials used in the manufacture of the traffic ticket book holder 10.

Figure 7:
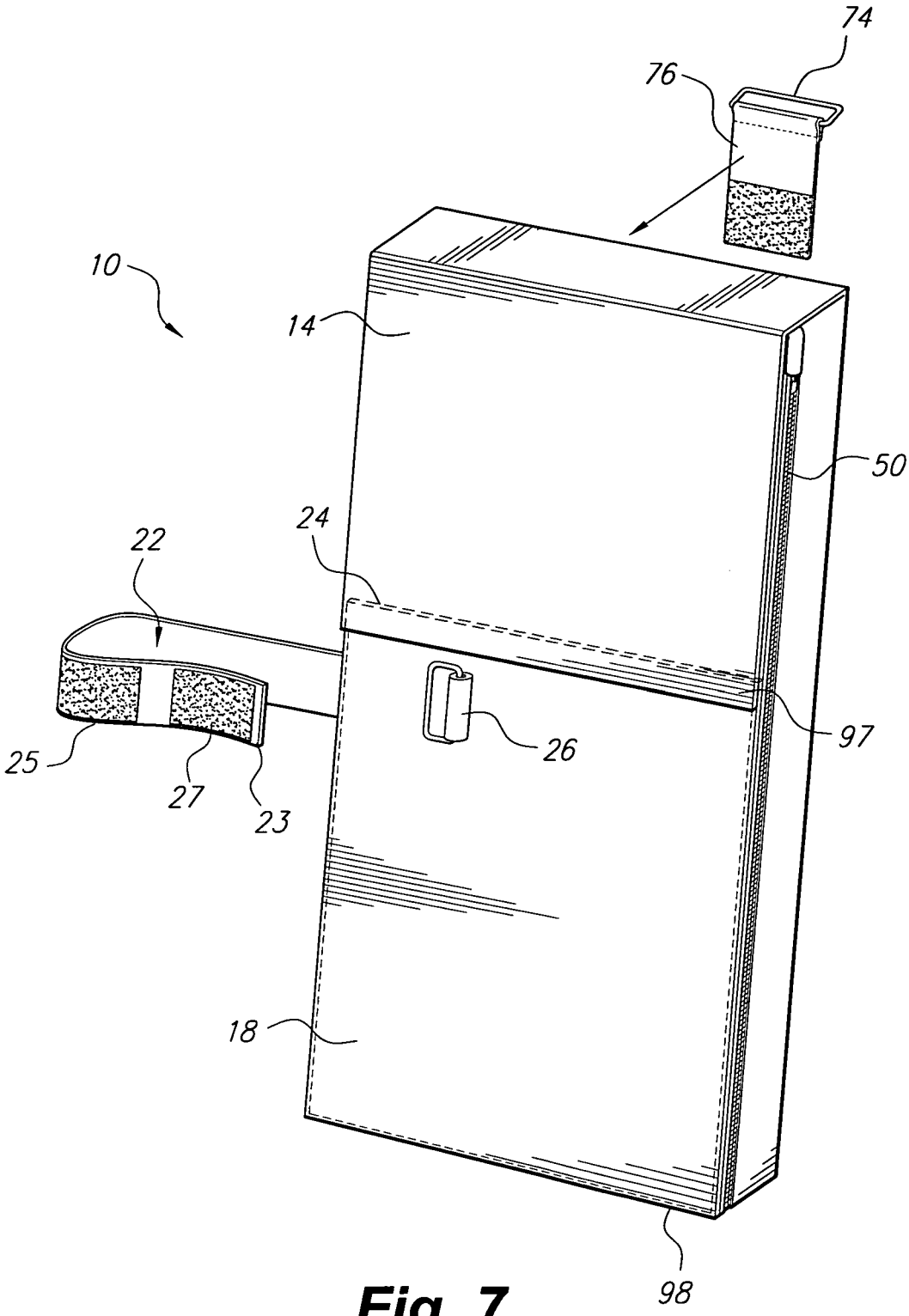
FIG. 7 is a front perspective view of a second embodiment of a traffic ticket book holder.

In another embodiment, as depicted in FIG. 7, the traffic ticket book holder 10 is secured to the arm of a user by a single flexible strap 22. The flexible arm strap 22 is attached to the rear surface 19 and is wrapped around the arm of the officer so as to comfortably secure the traffic ticket book holder 10. The arm strap 22 has a free end 23 that is fed through a buckle 26, which is then tightened and folded back and secured with hook and loop fasteners 25 and 27 located near the free end 23 of the arm strap 22. In this manner, a police officer can release the traffic ticket book holder 10 by pulling on the free end 23 to release the arm strap 22. One skilled in the art will appreciate that the fixed end of the arm strap 22 can also be attached to the front cover 18 instead of the main body 21.

Also in this embodiment, a zipper track 50 runs continuously along the upper side 97, lateral side 89, and the bottom side 98. In this manner, only one zipper head 46 is used to open and gain access to the ticket compartment 70. It will be appreciated that with this design there is no need for the drawstring 54 or its related parts. In this embodiment, a protective flap 14 is pivotally hinged along the upper edge, where the front cover 18 meets the upper side 97, so as to shield the outside pocket 24.

Figure 8:
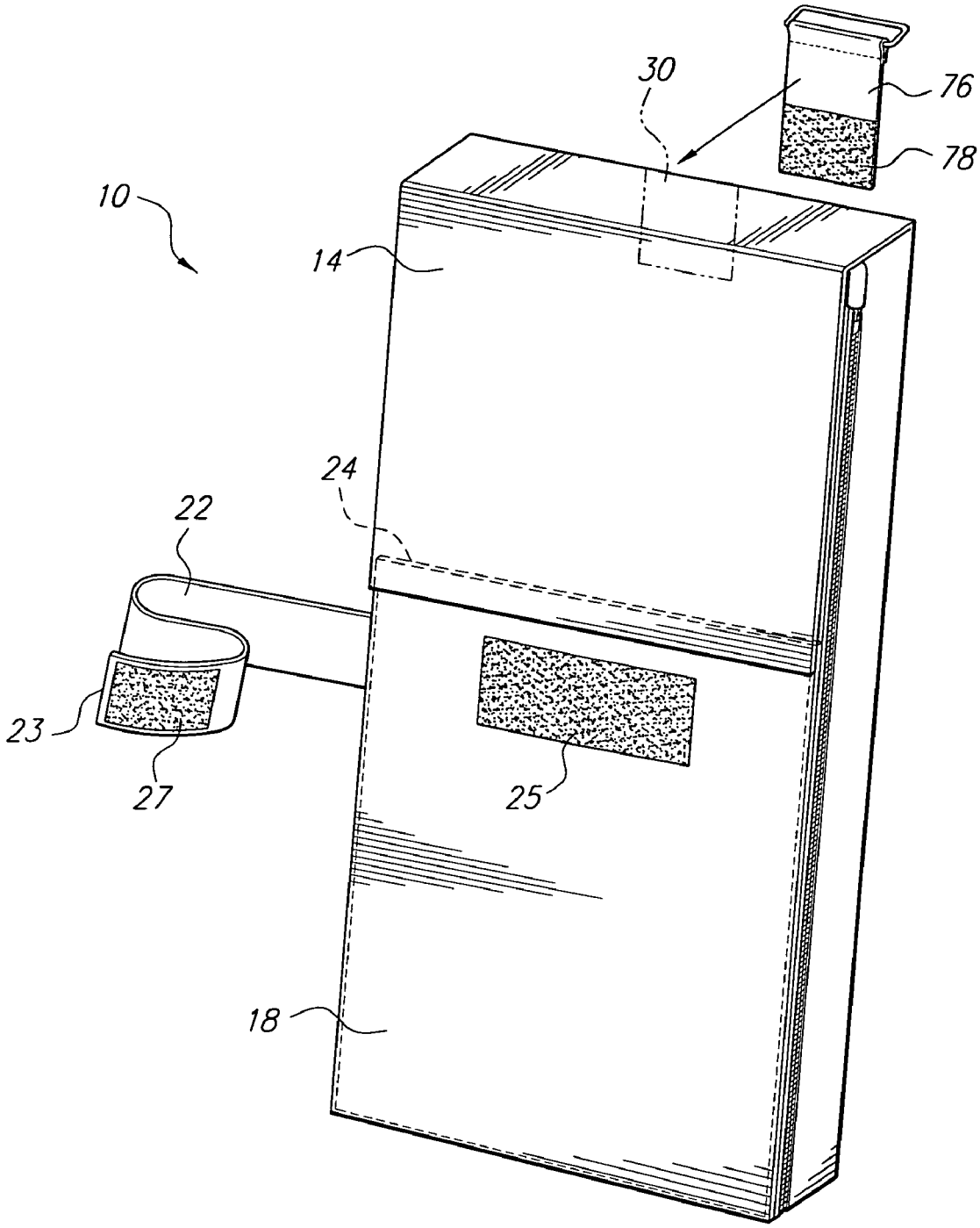
FIG. 8 is a front perspective view of a third embodiment of a traffic ticket book holder.

FIG. 8 depicts another preferred embodiment of the traffic ticket book holder 10. The front cover 18 has a loop portion of a hook and loop fastener 25. The arm strap 22 has a hook end of a hook and loop fastener 27 located at the free end of the strap 23 so as to couple with the loop portion of the hook and loop fastener 25. To remove the traffic ticket book holder 10, the free end of the strap end 23 is unlatched from the loop portion of the hook and loop fastener 25 and the traffic ticket book holder 10 is detached. For reattachment, the opposing hook and loop fastener 78 and upper rear end fastener 30 are mated and the arm strap 22 is longitudinally wrapped around the arm of the officer and secured to the front cover 18.

Figure 9:
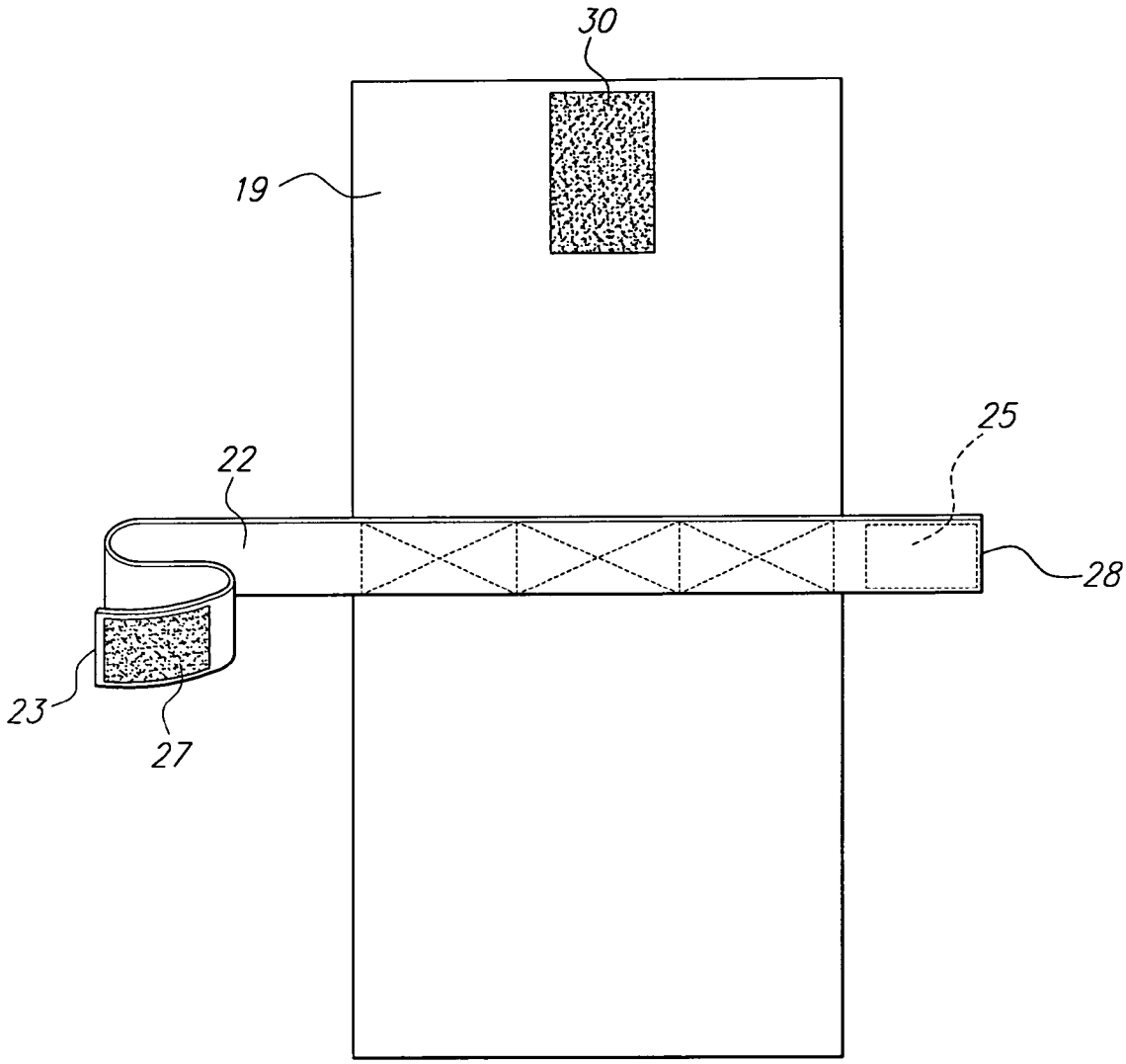
FIG. 9 is a rear perspective view of a fourth embodiment of a traffic ticket book holder.

FIG. 9 is a rear view of another embodiment of the traffic ticket book holder 10. This embodiment is different from the previous embodiments in that the arm strap 22 is secured to the rear surface 19 of the traffic ticket book holder 10. Additionally, the first end 28 of the arm strap 22 is partially exposed with a hook and loop fastener 25 to act as a latching tab with the strap fastener 27 of the free end of the strap 23. Once again a lower fastener may be placed below the arm strap 22 on the rear surface 19. In this manner, the arm strap 22 does not wrap around or attach to the front cover 18. The traffic ticket book holder 10 is secured to the user's arm but also allows access to the contents in the ticket compartment 70, without having to remove the traffic ticket book holder 10 from the officer=s or user's arm.

Figure 10:
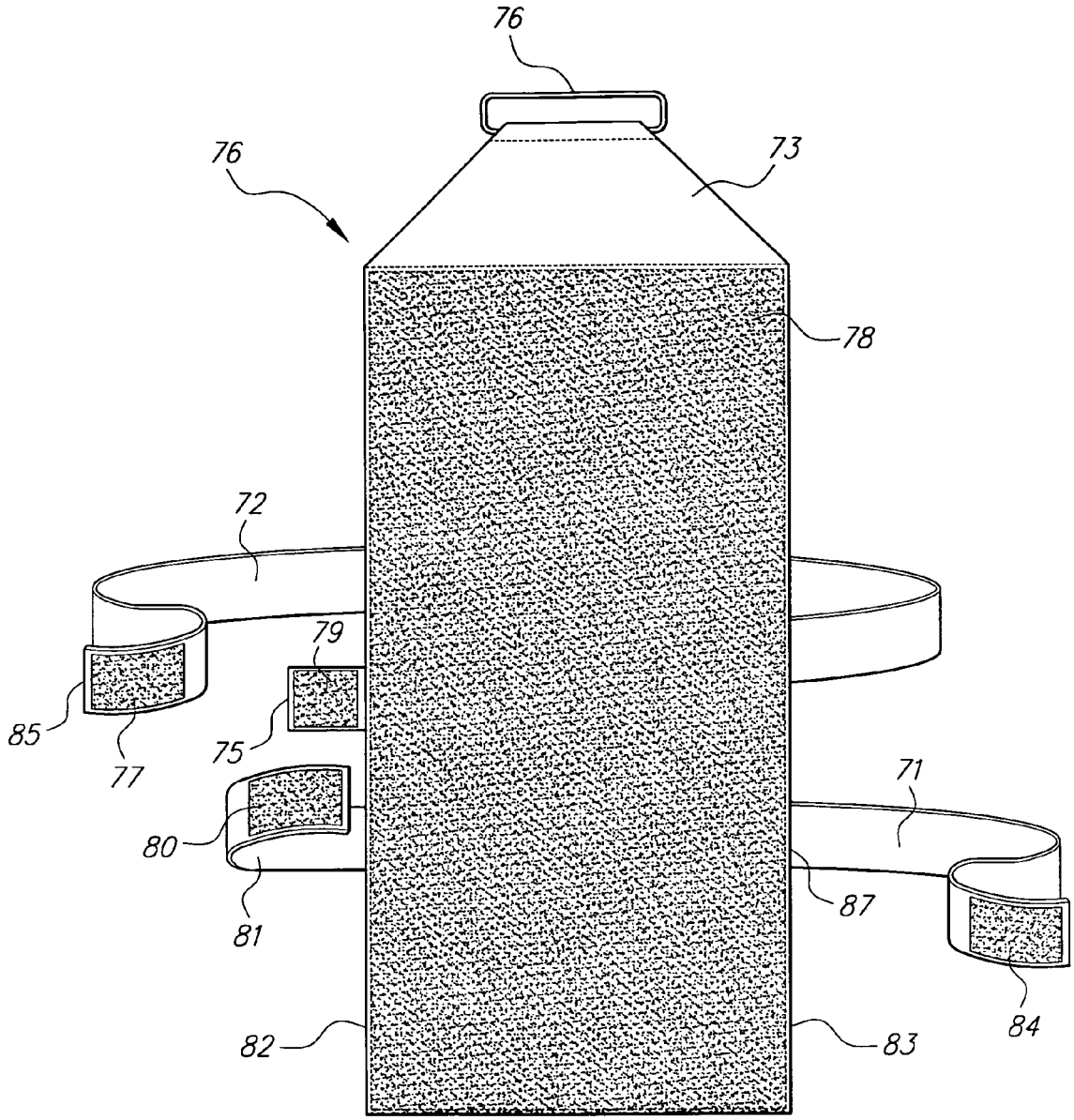
FIG. 10 is a front perspective view of a shoulder harness used with a traffic ticket book holder.

FIG. 10 discloses another embodiment of the shoulder strap 76. In this embodiment, the shoulder strap 76 substantially extends the length and width of the rear surface 19. Likewise, the opposing hook and loop fastener 78 extends substantially over the exposed surface of the opposing hook and loop fastener 78. However, the opposing hook and loop fastener 78 may optionally extend along portions of the surface of the shoulder strap 76. With the upper rear fastener 30 of the traffic ticket book holder 10 substantially extending over the rear surface 19, the traffic ticket book holder 10 will be secured when attached to the shoulder strap 76. Thus the holder strap 71 may optionally be omitted. The shoulder strap 76 may be made of slightly more rigid material to further prevent unwanted movement of the traffic ticket book holder 10. At the upper section of the shoulder strap 73 is a section of soft material to conform to the contour of the shoulder of the officer for additional comfort.

There is also an arm tab 79 that has a tab fastener 75 that releasably mates with the free end fastener 77 of the arm strap 72. The arm strap 72 has an arm fastener 86 rigidly secured along the edge of the right shoulder 83. The arm strap 72 wraps around the upper arm of the officer to secure the shoulder strap 76 to the arm. The holder strap 71 wraps around the traffic ticket book holder 10 to prevent dislodging from the attached position. The holder strap 71 is releasably secured to holder tab 81 via holder tab fastener 80 and holder tab fastener 84.

Figure 11:
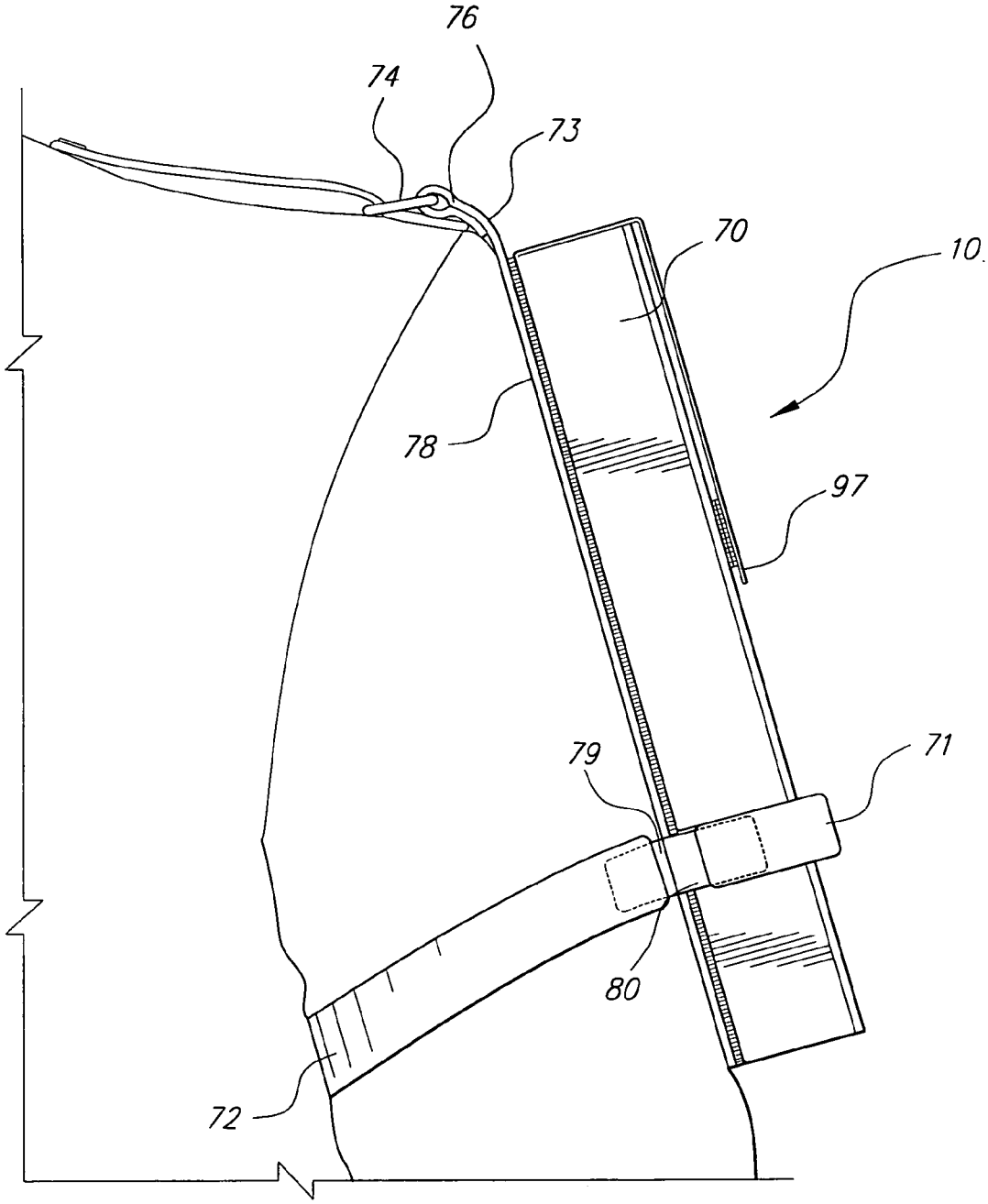
FIG. 11 is an environmental side perspective view of the shoulder harness depicted in FIG. 10, used with a traffic ticket book holder.

FIG. 11 discloses another embodiment of the shoulder strap 76 in FIG. 10, with another embodiment of the traffic ticket book holder 10 in a closed position. The shoulder strap 76 affords the ability of access to the ticket compartment 70 without removing the traffic ticket book holder 10. To remove the traffic ticket book holder 10, the holder strap 71 is unlatched from the holder tab fastener 80 and the traffic ticket book holder 10 is pulled away from the shoulder strap 76.

The traffic ticket book holder 10 has access to the ticket compartment 70 along the upper end of the traffic ticket book holder 10. The front cover 18 is rigidly secured to and is part of the main body 21. The upper side 97 is now opened to allow access to the ticket compartment 70 with no zippers being utilized. Instead, the protective flap 14 is the sole mechanism to open and close the ticket compartment 70.

Figure 12:
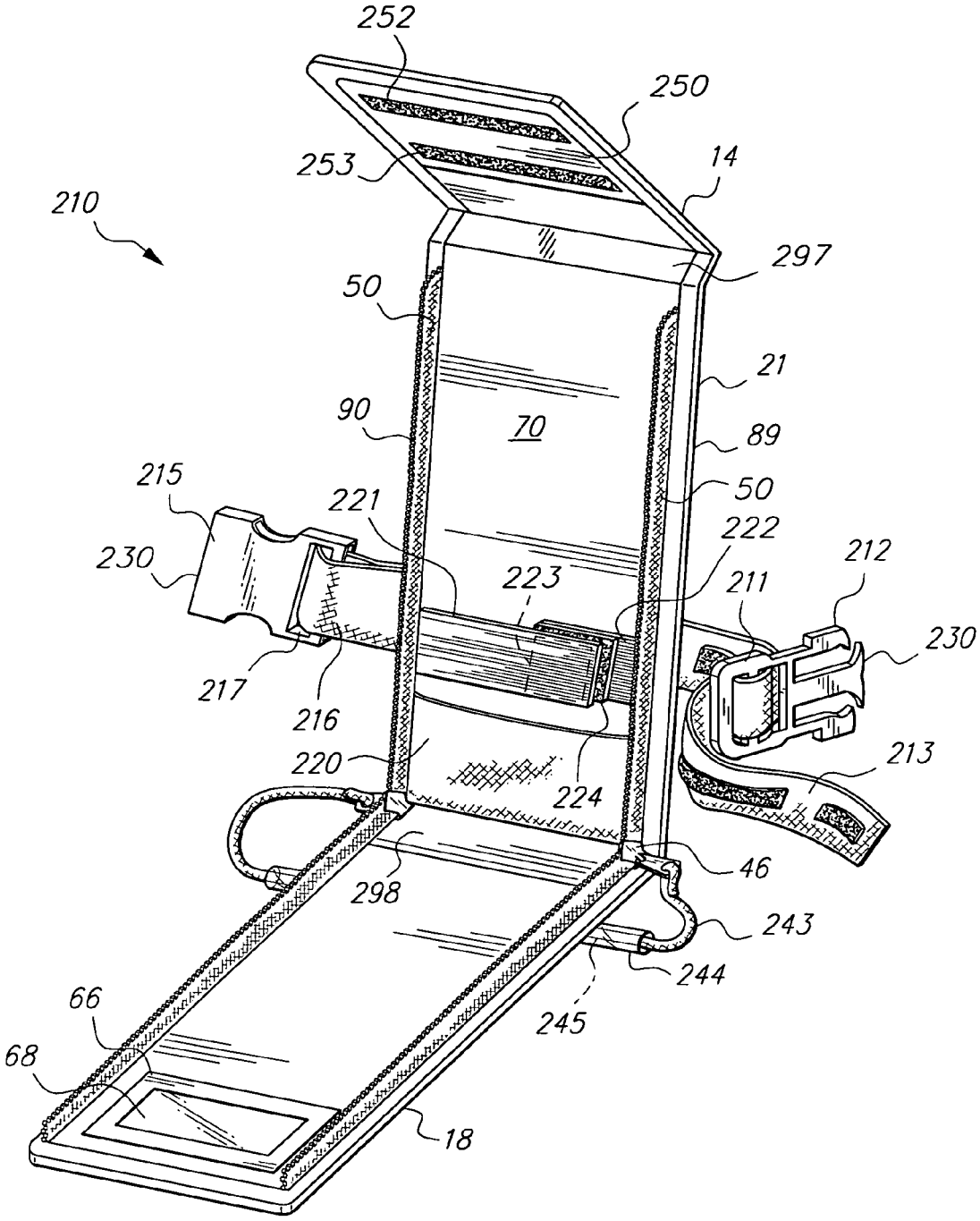
FIG. 12 is a perspective view of a fifth embodiment of a traffic ticket book holder in a fully open position.
Figure 13:
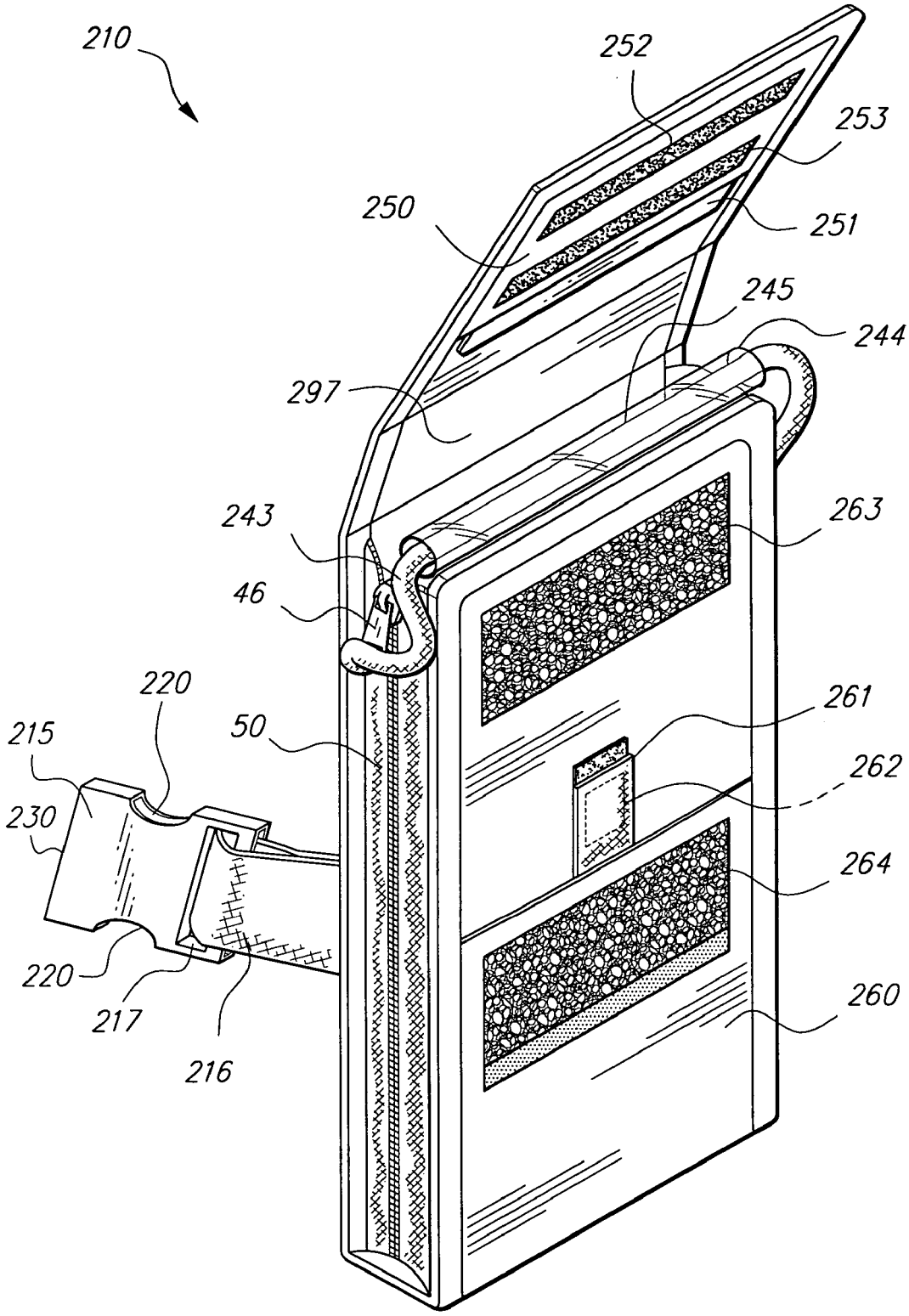
FIG. 13 is a perspective view of a traffic ticket book holder of the fifth embodiment in a partially open position.
Figure 14:
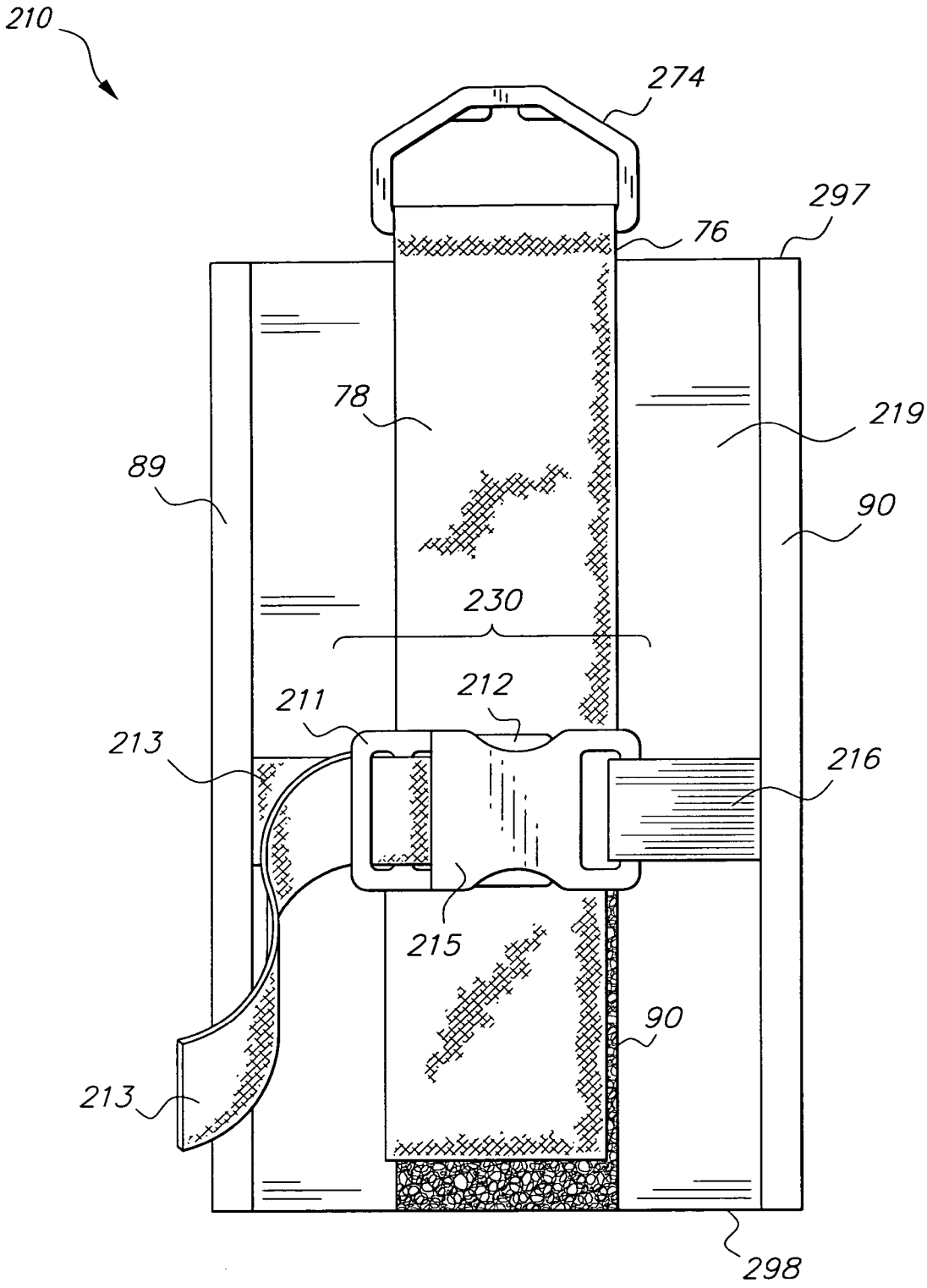
FIG. 14 is a back view of the fifth embodiment of a traffic ticket book holder.

A fifth embodiment of the traffic ticket book holder 210 is depicted in FIGS. 12–14 that can be suspended from a loop on a user's belt and affixed to a user's thigh for easy access. FIG. 12 shows a traffic ticket book holder 210 wherein main body 21 is connected to protective flap 14 by a top panel 297 and connected to front cover 18 by a bottom panel 298. Traffic ticket book holder 210 is formed of a durable wear-resistant waterproof material such as Cordura and Nylon, for example. Preferably, the elongated body of holder 210 is formed from Cordura. The parts are stitched together to form pockets for articles, padding and a pair of substantially rigid flat elongated shape retaining elements (not shown) within main body 21. A sturdy hem is sewn around the perimeter of the holder 210. Zipper tracks 50 connect the right lateral sides 89 of main body 21 and front cover 18 together and the left lateral sides 90 of main body 21 and front cover 18 together. Main body 21, front cover 18, top panel 297, bottom panel 298 and zipper tracks 50 define ticket compartment 70.

A handle is formed on drawstring 243 in the form of a rigid rod 245 positioned inside the drawstring 243 and a co-extensive flexible tube 244 surrounding drawstring 243. Each end of drawstring 243 is attached to a zipper head 46 so that pulling on handle 244 moves zipper heads 46 to open and close ticket compartment 70.

A flexible thigh strap 213 is provided to secure the traffic ticket book holder 10 to the outer thigh of a police officer or other user. One end of the flexible thigh strap 213 is attached adjacent to the right lateral side 89 of main body 21 of the traffic ticket book holder 210. Elongated hook and loop fastener strips 232 and 233 are centrally attached along the length of flexible thigh strap 213. The free end of the flexible thigh strap 213 is passed through a pair of openings in a strap adjustment portion 211 on the releasable portion 212 of a snap clip 230. The free end of thigh strap 213 is bent back upon itself so that releasable portion 212 is releasably secured in position on thigh strap 213 by fastener strips 232 and 233.

One end of an elastic band 216 is passed through an attachment aperture 217 of buckle portion 215 of snap clip 230 and both ends of band 216 are attached adjacent to the left lateral side 90 of main body 21 of the traffic ticket book holder 210. The releasable portion 212, when engaged with the buckle portion 215, together makes up the snap clip 230 as shown in FIGS. 12 and 14. When the releasable portion 212 is received in the buckle portion 215, the snap clip 230 secures flexible strap 213 around the thigh of a user. The strap adjustment portion 211 is readily accessible to a user for adjusting the position of the releasable portion 212 of snap clip 230 along the length of flexible thigh strap 213. Thus the strap adjustment portion 211 provides for varying thigh sizes. The elastic band 216 provides for easy adjustment of the flexible thigh strap 213 for comfort without cutting off blood circulation and providing enough tension to secure the traffic ticket book holder 210 to the thigh of a user.

The flexible thigh strap 213 may be manufactured of stretchable material to provide a snug fit around the outer thigh of the police officer or user. The flexible thigh strap 213 further prevents the traffic ticket book holder 10 from dislodging when brushed up against something. The strap adjustment portion 211 can be designed as various different mechanisms so long as an adjustment of the flexible thigh strap 213 is allowed to conform to the size of the user's thigh and retain the traffic ticket book holder 210 in an attached position.

A pocket 220 is provided on a lower front portion of the main body 21 for receiving at least one ticket book. A first resilient strap 221 is attached at one end adjacent left lateral edge 90 of main body 21 slightly above pocket 220. The free end of strap 221 is provided with a hook and loop fastener patch 223. A second resilient strap 222 is attached at one end adjacent right lateral edge 89 of main body 21 slightly above pocket 220. The free end of strap 222 is provided with a hook and loop fastener patch 224 positioned for releasable attachment to fastener patch 223. The resilient straps 221 and 222 cooperate to resiliently secure one or more ticket books in compartment 70.

As best seen in FIG. 12, pocket 250 is provided on the inner surface of flap 14 for holding a writing board 251. Hook and loop fastener strips 252 and 253 are secured onto the pocket 250. FIG. 13 shows that the bottom end of the outer surface of front cover 18 is provided with a pocket 260 for additional items to be stored. Pocket 260 is provided with a tab 261 having a hook and loop fastener patch 262 for cooperating with hook and loop fastener patch positioned above pocket 260 to releasably close the opening of pocket 260. A hook and loop fastener strip 263 is secured to the top end of the outer surface of front cover 18 and a hook and loop fastener strip 264 positioned near the upper edge of pocket 260. Fastener strips 263 and 264 on front cover 18 cooperate with strip 252 and 253 on flap 14 to releasably close compartment 70 and protect the contents of pocket 206 from the weather.

An elongated belt strap 76 is releasably secured coextensively onto a back surface 219 of said main body 21. An upper end of belt strap 76 includes a D-ring 274 for receiving a loop attached to a user's belt for suspending the ticket book holder 210 from the user's belt.

Other professionals, such as security guards, military personnel and firefighters, can use the traffic ticket book holder 210. The traffic ticket book holder 210 need not be solely used for tickets. For example, the traffic ticket book holder 210 can be used to carry a two-way radio or a homing device to track the position of an individual. This may be advantageous when entering a building and getting the position of military personnel in a battle zone or maneuvers out in the field. It can be appreciated to one skilled in the related art that the traffic ticket book holder 210 may be secured to the leg of the police officer in many different ways and have the thigh strap secured in various places using various methods.

Fastening the shoulder flap of a user's uniform may be accomplished using various devices and methods. For example, instead of the shoulder ring 74, the shoulder strap 76 could have a hole (not shown) to loop the shoulder flap through to attach to the uniform and utilize a releasable buckle (not shown) to secure the traffic ticket book holder 10 instead of hook and loop type fasteners. Also the traffic ticket book holder 10 may have only one zipper head 46 for opening the ticket compartment 70. The traffic ticket book holder 10 could also be designed in various ways. This and other variations of the invention are within the scope of the present invention.

It is to be understood that the present invention is not limited to the embodiments described above, but encompasses any and all embodiments within the scope of the following claims.

I claim:

1. A traffic ticket book holder comprising:

a main body connected to a protective flap by a top panel and connected to a front cover by a bottom panel;

a first zipper track having a zipper head connecting the right sides of said main body, said front cover and said bottom panel together;

a second zipper track having a zipper head connecting the left sides of said main body, said front cover and said bottom panel together;

said main body, front cover, top panel, bottom panel and the zipper tracks define a generally rectangular shaped ticket compartment for carrying a number of traffic ticket books and tickets;

an elongated flexible belt strap releasably attached to said main body having means for suspending said traffic book holder from a belt of a user;

a flexible thigh strap attached at one end to one edge of the main body of the traffic ticket book holder to the upper thigh area of the user;

a snap clip having a buckle portion, a strap adjustment portion and a releasable portion;

said strap adjustment portion being adjustably positioned on said thigh strap; and an elastic band passing through an aperture in said buckle portion having ends secured to said main body;

wherein when said releasable portion is received in said buckle portion, said snap clip secures said thigh strap around the thigh of a user.

2. The traffic ticket book holder according to claim 1, wherein said belt strap is attached to said main body with hook and loop fasteners.

3. The traffic ticket book holder according to claim 1, wherein the flexible thigh strap is made of stretchable material.

4. The traffic ticket book holder according to claim 1, wherein an identification pocket and window are used to hold identification in place.

* * * * *